United States Patent [19]

Linkner, Jr.

[11] Patent Number: 4,586,013

[45] Date of Patent: Apr. 29, 1986

[54] PROPORTIONAL SOLENOID

[75] Inventor: Herbert L. Linkner, Jr., Dexter, Mich.

[73] Assignee: Kelsey-Hayes Company, Romulus, Mich.

[21] Appl. No.: 656,572

[22] Filed: Oct. 1, 1984

[51] Int. Cl.[4] ..... H01F 7/08

[52] U.S. Cl. ..... 335/276; 335/281; 251/129.20

[58] Field of Search ..... 335/270, 274, 275, 276, 335/279, 281; 251/138

[56] References Cited

U.S. PATENT DOCUMENTS 3,340,487 9/1967 Gruner et al. ..... 335/279 X

FOREIGN PATENT DOCUMENTS 1325635 3/1963 France ..... 335/276
570404 12/1957 Italy ..... 335/276
2007915 5/1979 United Kingdom ..... 335/275

*Primary Examiner*—George Harris
*Attorney, Agent, or Firm*—Ralph J. Skinkiss; Mark J. Sobanski

[57] ABSTRACT

The present invention relates to a solenoid having a pole and armature construction wherein, when a predetermined constant current is applied to the solenoid winding, the magnetic force attracting the armature toward the pole decreases as the armature is moved in one direction relative to the pole and, the distance the armature is moved is substantially proportional to the current applied to the winding. These operating characteristics are achieved by a solenoid having a field member provided with a pole portion on one end thereof, and having an armature connected to the opposite end for movement relative to the pole portion. The armature is provided with an edge portion which is spaced from the pole portion to define an air gap therebetween. The pole portion produces a magnetic field which exerts a magnetic force on the armature edge portion in one direction relative to the pole portion. In accordance with the present invention, the armature edge portion and the pole portion are shaped to control the spacing of the air gap as the armature edge portion is moved in the one direction. By maintaining the air gap spacing substantially uniform, the magnetic force urging the armature edge portion in the one direction toward the pole member decreases as the armature is moved in the one direction, and the armature moves a distance proportional to the current applied to the winding. One application for the solenoid of the present invention is as a control device for a pressure regulating valve of type utilized in vehicle transmissions. In this application, the solenoid controls the valve such that the output pressure of the valve is inversely proportional to the current applied to the winding of the solenoid.

19 Claims, 11 Drawing Figures

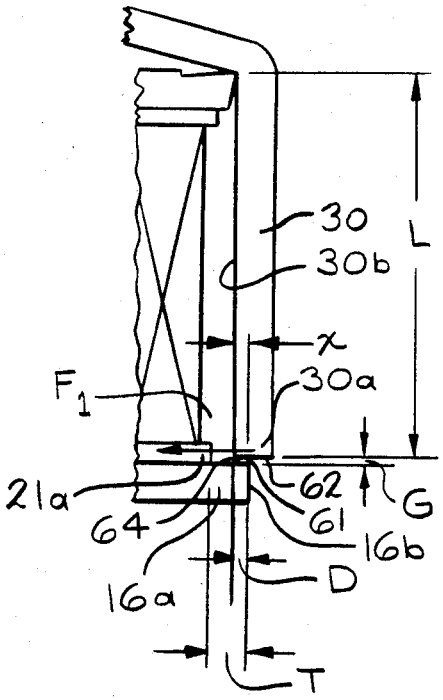
FIG. 6
FIG. 7a
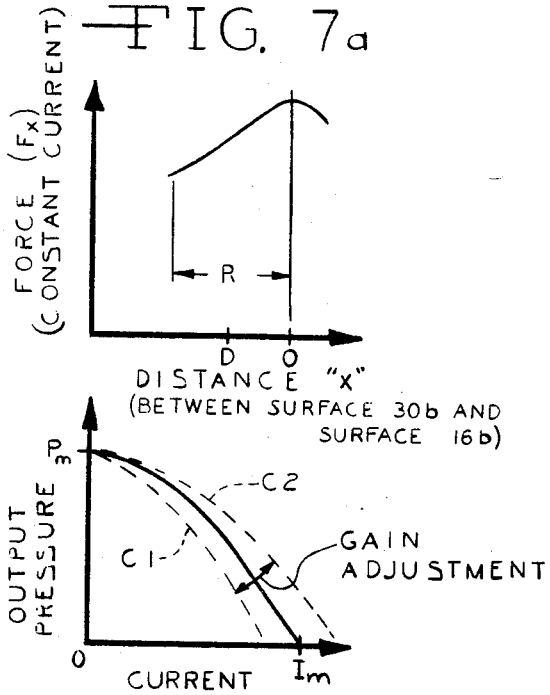
FIG. 7b
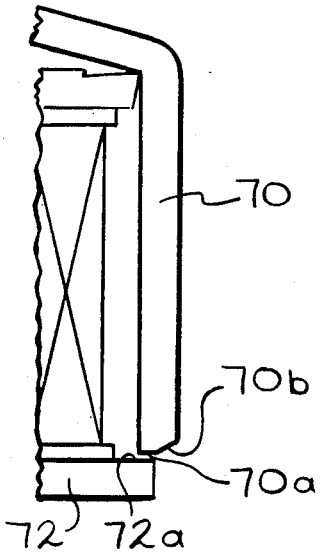
FIG. 8
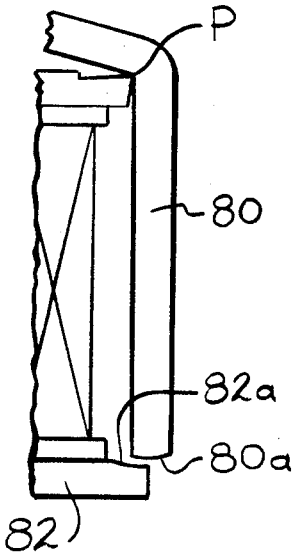
FIG. 9
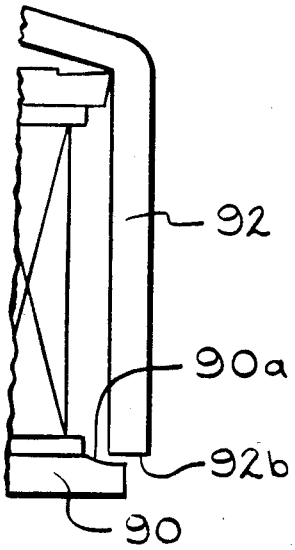
FIG. 10

PROPORTIONAL SOLENOID

BACKGROUND ON THE INVENTION

The present invention relates in general to an electromagnetic soleniod device having an armature mounted for movement in one direction relative to a pole portion of a field member upon application of current to a winding surrounding the field member and, in particular, to a solenoid device wherein the armature is moved in the one direction a distance which is substantially proportional to the current applied to the solenoid winding.

Solenoids have been widely used as a means to control various remotely located devices such as switches or valves. However, since the armature of a conventional solenoid is attracted to the pole with a force that increases sharply as the distance between the armature and the pole decreases, such solenoids are typically used to provide control functions wherein a device must be moved between only two positions such as, for example, on/off or open/closed. It has been difficult to utilize conventional solenoids to control displacement sensitive devices because of stability problems in maintaining such a device at an intermediate position.

U.S. Pat. No. 3,993,972 discloses an electromagnetic device having a pole construction adapted to control the effective reluctance of the magnetic circuit to reduce the tendency for the magnetic force exerted on the armature to rise steeply as the air gap between the pole and the armature decreases. In the device of this patent, an armature is spring biased away from a pole piece and is attractable toward the pole piece when current is supplied to a winding surrounding the pole piece. The pole piece includes a portion of reduced cross section which provides a restriction in the magnetic circuit such that, as the magnetizing force through the pole piece increases, the effective reluctance of the magnetic circuit increases. This results in the distance through which the armature moves against the action of the spring to be substantially proportional to the current flowing in the winding.

SUMMARY OF THE INVENTION

The present invention relates to a soleniod device wherein, when a constant current is applied to the solenoid winding, the magnetic force urging the armature in one direction relative to a pole portion of the field member decreases as the armature moves through a predetermined range of movement. Also, with the solenoid of the present invention, the armature is moved in the one direction a distance substantially proportional to the current applied to the solenoid winding. It has been found that a solenoid having such operating characteristics is extremely effective in controlling displacement sensitive devices such as, for example, feedback valves.

The solenoid includes a field member provided with a pole portion on one end thereof, and a winding surrounding at least a portion of the field member. An armature is connected to the opposite end of the field member for movement relative to the pole portion. The armature includes an edge portion moveable in one direction relative to the pole portion from a first position to a second position upon application of a predetermined current to the winding. The armature edge portion is spaced from the pole portion to define an air gap therebetween. Means are provided for biasing the armature edge portion in an opposite direction.

When current is applied to the winding, the pole portion produces a magnetic field which exerts a magnetic force on the armature edge portion to urge the armature edge portion in the one direction against the action of the biasing means. In accordance with the present invention, the armature edge portion and the pole portion are shaped to control the rate of change of the magnetic energy in the air gap such that, when a predetermined constant current is applied to the solenoid winding, the magnitude of the magnetic force in the one direction decreases as the armature portion moves in the one direction and, the armature is moved in the one direction a distance substantially proportional to the current applied to the winding. It has been found that an armature edge portion and pole portion shape wherein the air gap spacing remains substantially uniform as the armature edge portion moves from the first position to the second position causes the magnetic energy in the air gap to change at a rate which achieves the desired operating characteristics.

It has been discovered that a solenoid construction which enables the above operating characteristics to be achieved includes a core member having an axis and a winding coaxially positioned around the core axis. The core member is provided with a pole plate at one end thereof located in a plane generally perpendicular to the axis. The pole plate includes a pole plate edge portion extending outwardly from the core axis past the winding. A pivot plate is mounted on the other end of the core member and is located in a plane generally perpendicular to the core axis.

An armature is pivotally mounted on the pivot plate and includes an armature plate extending toward the pole plate edge portion. The armature plate includes an armature plate edge portion axially spaced from and generally parallel to the pole plate edge portion. Means are provided for biasing the armature plate away from the axis of the core member. When a predetermined current is applied to the winding, the armature plate pivots and the armature plate edge portion moves toward the axis of the core member. Such a structure enables the magnitude of the magnetic force on the armature plate to be controlled as the armature plate moves toward the core axis such that the solenoid has the operating characteristics as described above.

One application for a solenoid valve of the present invention is for use in controlling a pressure regulating valve unit of the type typically utilized in vehicle transmissions. The valve unit includes an input port for receiving fluid at a predetermined supply pressure and an output port for delivering fluid at a desired output pressure. The desired output pressure of the valve unit is controlled by positioning a moveable valve spool in a selected position. A solenoid unit of the type described above can be coupled to operate the valve unit. It has been found that solenoid unit of the present invention provides an electronic control wherein the output pressure of the valve is inversely proportional to the current applied to the solenoid winding.

BRIEF DESCRIPTION OF THE DRAWINGS

The above, as well as other advantages of the present invention, will become readily apparent to one skilled in the art from reading the following detailed description in conjunction with the attached drawings, in which:

FIG. 6 is a fragmentary side elevational view illustrating the specific construction of the end portions of the armature and pole plates;

FIGS. 7*a* and 7*b* are graphs showing the operating characteristics of the solenoid of the present invention; and FIGS. 8, 9, and 10 are side elevational views illustrating alternate embodiments of the end portions of the pole plate and the armature plate.

DESCRIPTION OF THE PREFERRED EMBODIMENT

Figure 1:
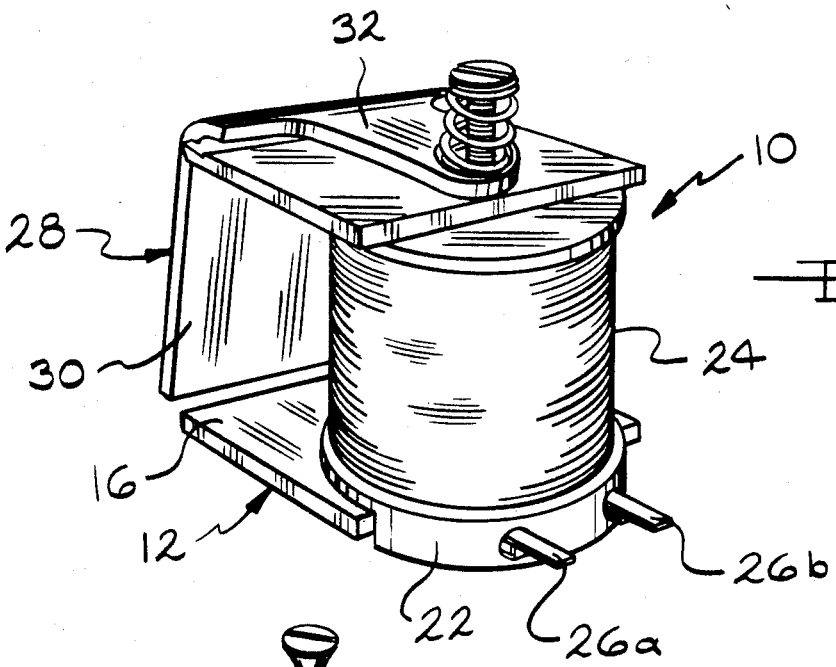
FIG. 1 is a perspective view of a solenoid unit of the present invention.
Figure 2:
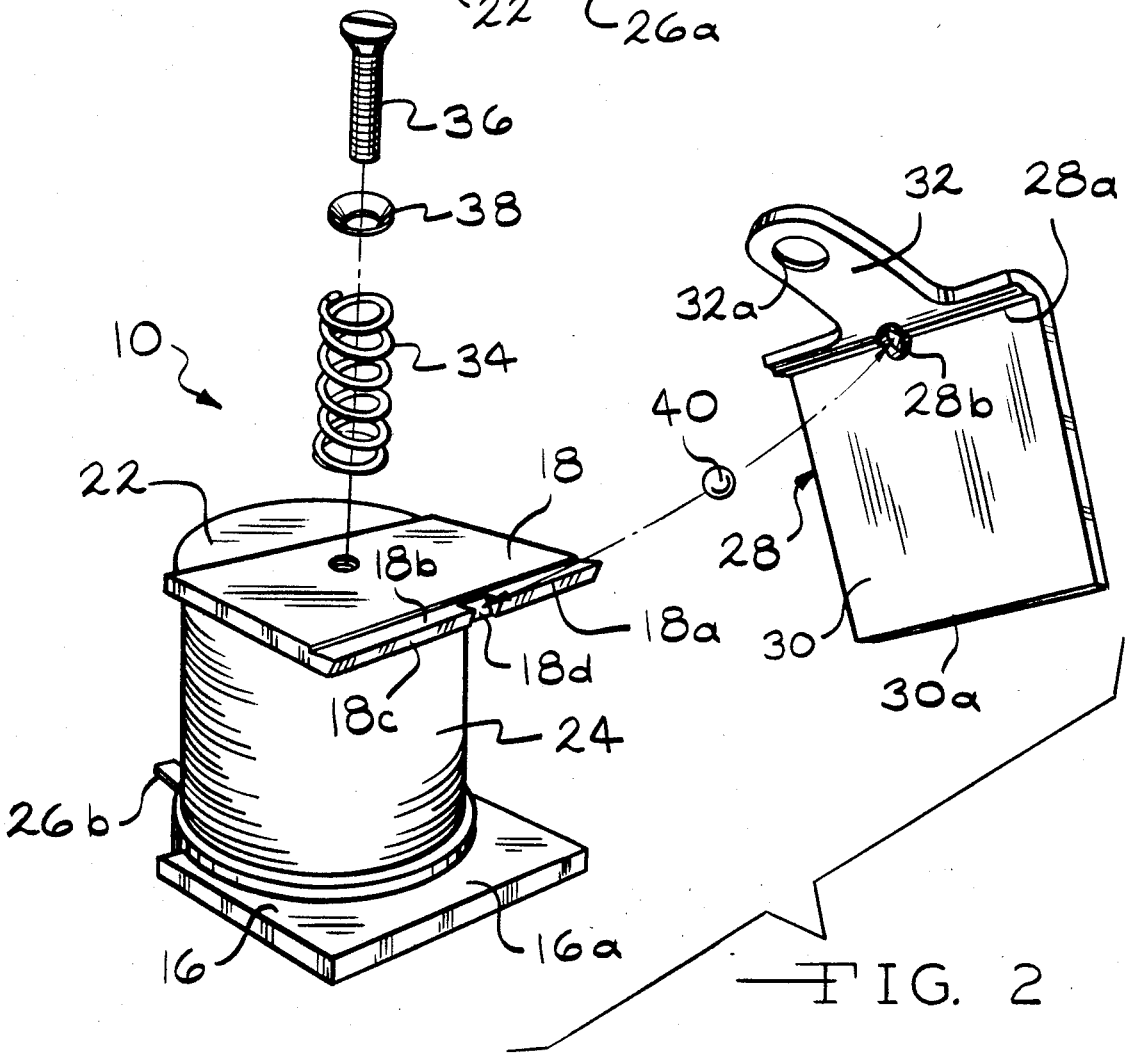
FIG. 2 is an exploded perspective view illustrating the main components of the solenoid unit of FIG. 1.
Figure 3:
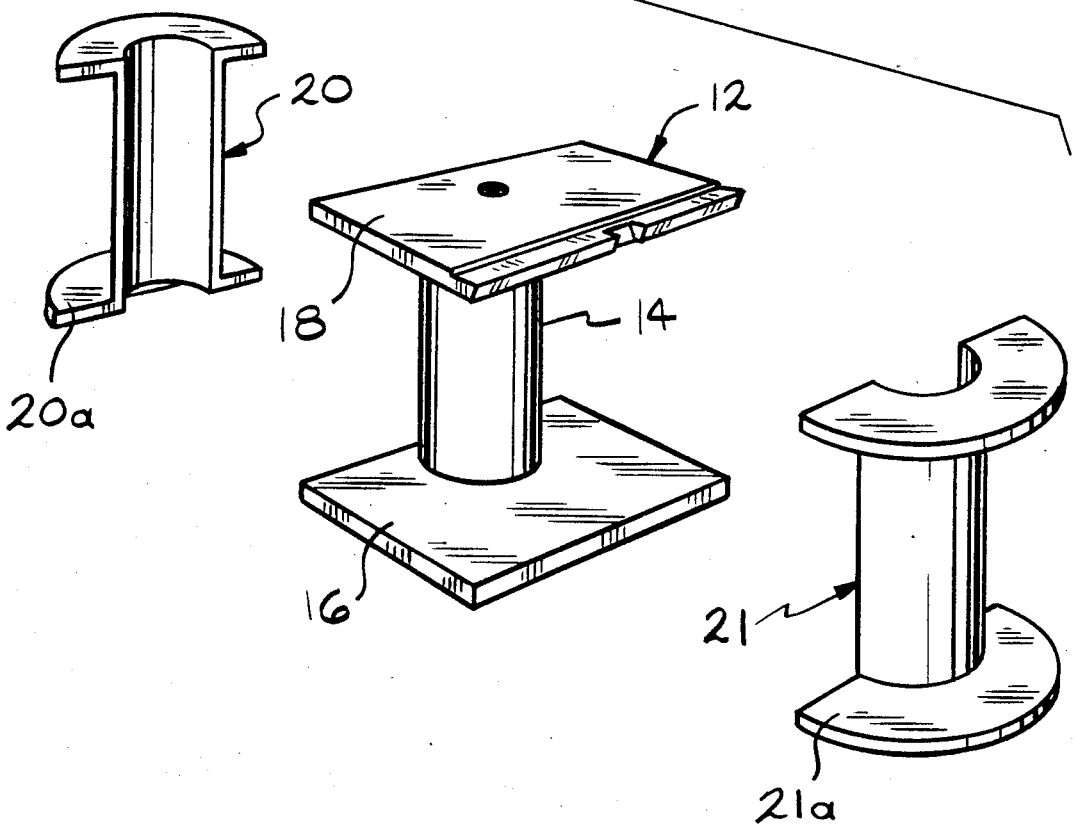
FIG. 3 is an exploded perspective view illustrating the central tube and pole member and the insulating bobbin around which the windings are positioned.
Figure 4:
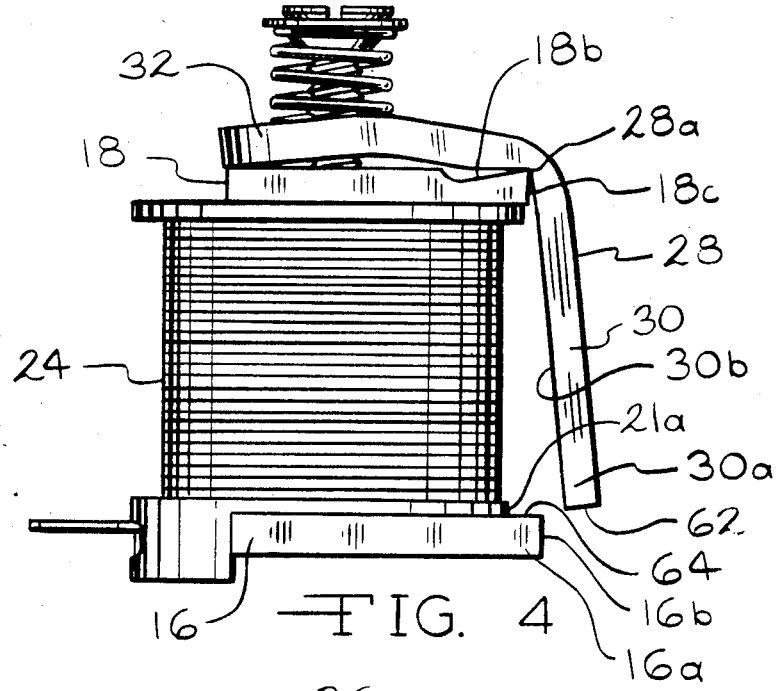
FIG. 4 is a side elevational view of the solenoid unit shown in FIG. 1.

Referring to FIGS. 1 through 5, there is shown a preferred embodiment of a solenoid 10 having a construction according to the present invention. The solenoid 10 includes a field member 12 consisting of a central core 14 (shown in FIGS. 3 and 5), a lower pole plate 16, and an upper pivot plate 18, all of which can be constructed of a ferromagnetic material such as low carbon iron. The central core 14 can be attached to the lower pole plate 16 and the upper pivot plate 18 by spot welding, for example.

A pair of plastic insulating members 20 and 21 (shown in FIG. 3) having lower flanges 20*a* and 21*a* respectively cooperate to form a bobbin 22 which surrounds the core 14. The bobbin 22 supports windings 24 in coaxial relationship about the core 14. A pair of winding terminals 26*a* and 26*b* extend outwardly from the lower flange 20*a* of the bobbin member 20 and are adapted to be connected to a current source (not shown) for inducing a magnetic field through the field member 12.

An armature 28 is mounted for movement relative to the field member 12. In the preferred embodiment of the solenoid shown in the drawings, the armature 28 is a generally L-shaped lever constructed of a ferromagnetic material such as low carbon iron, and is pivotally mounted along an upper pivot edge 18*a* of the upper pivot plate 18. The armature 28 includes a plate member 30 extending downwardly toward an edge portion 16*a* of the lower pole plate 16, and a biasing leg 32 extending across the upper pivot plate 18. The armature plate 30 includes a lower edge portion 30*a* spaced from and generally parallel to the pole plate edge portion 16*a*.

The armature 28 is biased such that the armature plate 30 is urged away from the windings 24 by means of a biasing spring 34 adapted to exert a downward force on the biasing leg 32. The force exerted on the leg 32 is set by an adjusting screw 36 extending through an aperture 32*a* formed in the biasing leg 32 and threaded into the upper pivot plate 18 and the central tube 14. A tapered washer 38 provides an upper seat for the spring 34, while an upwardly facing annular shoulder 32*b* formed in the leg 32 through the aperture 32*a* provides a lower spring seat.

When a predetermined current is applied to the winding 24, a magnetic field is produced through the field member 12 which exerts a magnetic force on the armature 28 to cause the armature plate 30 to be pulled toward the windings 24. The adjusting screw 36 is utilized to set a biasing force opposing the magnetic force on the armature plate 30. The inward movement of the armature plate 30 is limited by the lower bobbin flange 21*a*. As will be discussed, the configuration of a downwardly facing surface 62 of the armature plate lower edge portion 30*a* and an upwardly facing surface 64 of the pole plate outer edge portion 16*a* and the relative movement therebetween are such that, when a predetermined constant current is applied to the winding 24, the armature plate 30 is pulled toward the winding by a force which decreases as the plate 30 moves closer to the winding.

The present invention provides a relatively low friction pivot between the armature 28 and the upper pivot plate 18 to minimize any mechanical hysteresis. This low friction pivot is achieved by providing inclined surfaces 18*b* and 18*c* along the pivot edge 18*a* of the plate 18 to produce a "knife edge" pivot line. The pivot line contacts the armature along the line 28*a*. Any lateral movement of the armature along the edge of the upper pole plate is resisted by a steel ball 40 seated within and projecting outwardly from a central cavity 28*b* formed in the armature 28 along the pivot line 28*a*. The ball 40 is received within a centrally located notch 18*d* formed along the upper edge 18*a* of the pole plate 18. It has been found that the ball 40 provides a lower reluctance magnetic linkage between the armature 28 and the pivot plate 18 and thus increases the output force of the solenoid.

Figure 5:
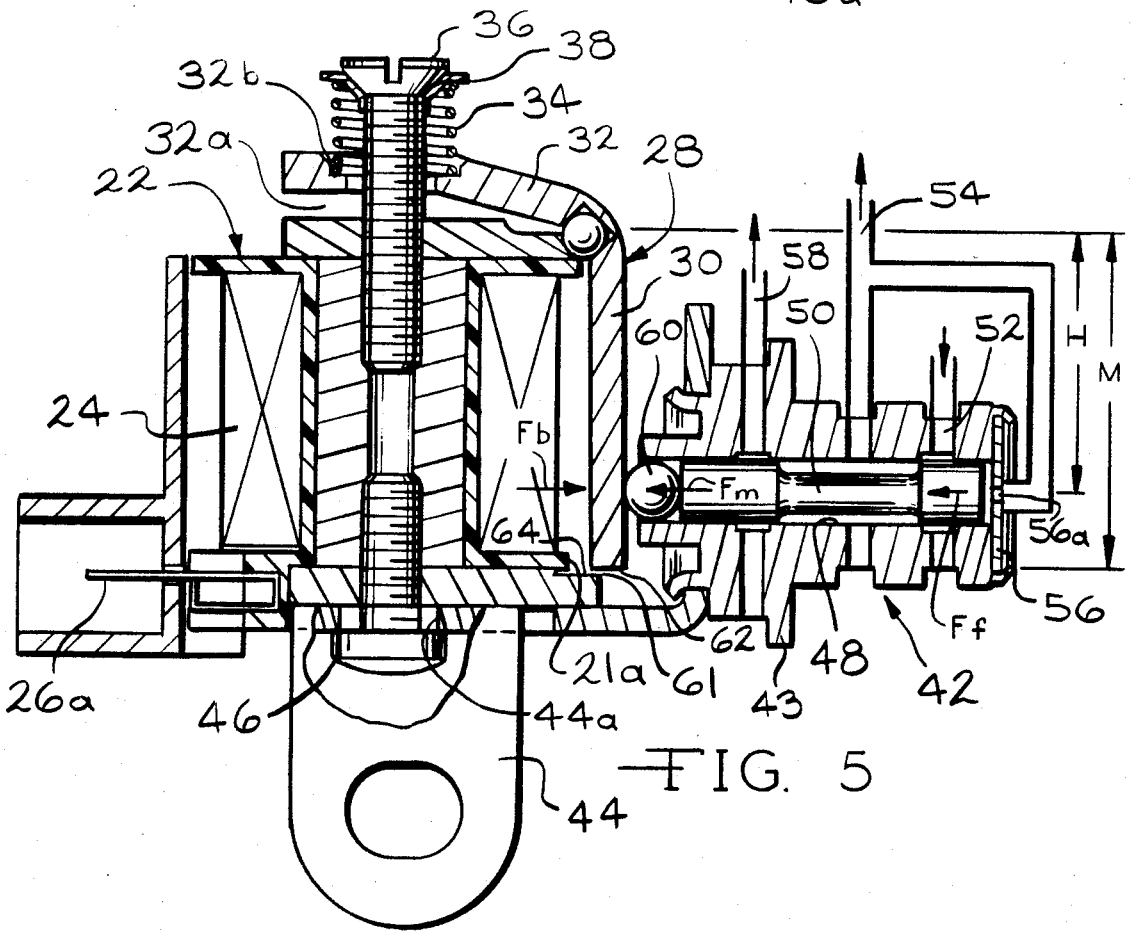
FIG. 5 is a sectional view illustrating the solenoid unit of FIG. 1 as utilized to control a pressure regulating valve.

While the solenoid of the present invention can be used for a variety of control functions, one specific application is as an actuator for a pressure control valve of the type utilized in vehicle transmissions. Such an application is illustrated in FIG. 5. As shown in FIG. 5, a pressure control valve 42 includes a main body 43 supported in a predetermined position relative to the solenoid 10 by a support bracket 44 attached to the lower end of the solenoid by a threaded fastener 46. The position of the solenoid 10 relative to the control valve 42 can be adjusted by loosening the fastener 46, and moving the solenoid 10 either toward or away from the valve 42 along a slot 44*a* provided in the bracket 44. As will be discussed, this adjustment provides a means for setting the gain of the electronic valve assembly.

The valve body 43 includes a central bore 48 having a axially slideable valve spool 50 mounted therein. The valve body 43 is provided with an input port 52 which receives a supply of fluid (not shown) at a predetermined supply pressure. The axial position of the valve spool 50 is controlled in order to direct the fluid from the input port 52 through the central bore 48 to an output port 54 such that the fluid is delivered from the output port 54 at a desired output pressure. Fluid at the actual output pressure is supplied to the one end of the spool 50 through an orifice 56*a* in an end plate 56 and exerts a feedback force $F_f$ on the valve spool 50 which urges the valve spool toward the armature plate 30. It has been found that the orifice 56*a*, which is smaller in cross section that the central bore 48, stabilizes the axial position of the spool 50 and substantially reduces oscillations of the spool. An exhaust port 58 is provided to selectively reduce the output pressure at the port 54.

The armature plate 30 is coupled to control the axial position of the valve spool 50. As shown in FIG. 5, a ball 60 is utilized to transmit movement between the armature plate 30 and the valve spool 50. It has been found that coupling the armature plate to the valve spool by means of the ball 60 substantially reduces any radial forces on the spool and also minimizes the mechanical hysteresis of the connection. Also, since the ball 60 is located a distance H from the pivot line 18*a*, and the magnetic forces are exerted on the plate 30 a distance M from the pivot line 18*a*, the magnitude of the force $F_m$ actually utilized to control the valve spool 50 is equal to the magnitude of the actual magnetic force in the same direction as $F_m$ at the end of the plate 30 (force $F_x$ as shown in FIG. 6) increased by a factor of M/H. This enables the solenoid to control a valve operating within an increased pressure range.

Normally, when no current is supplied to the solenoid winding, the magnitude of the magnetic force $F_m$ is zero, and a biasing force $F_b$ exerted on the valve spool 50 via the spring-biased armature 28 causes the spool 50 to move to the right, thus supplying fluid at the supply pressure from the supply port 52 to the output port 54. This causes the feedback force $F_f$ to increase as the output pressure increases. When the feedback force $F_b$ equals $F_f$, the spool 50 will move to the left to a balanced position wherein both the supply port 52 and the exhaust port 54 are closed. The zero current pressure ($P_m$) in the output line can be set by adjusting the screw 36 to adjust the biasing force $F_b$. The output pressure $P_m$ will always be equal to or less than the supply pressure at the port 52.

When a predetermined constant current is applied to the coil, a magnetic force will be exerted on the armature plate 30 to urge the armature plate 30 toward the winding. As mentioned above, this magnetic force is increased by a factor of M/H and is applied to the valve spool 50 as force $F_m$. When the magnetic force $F_m$ combined with the feedback force $F_f$ is sufficient to overcome the biasing force $F_b$, the armature plate 30 moves toward the winding. As the armature plate 30 moves toward the winding, the feedback force $F_f$ exerted on the valve spool 50 causes the spool to follow the armature plate 30 and position the armature plate such that $F_m+F_f=F_b$. This causes the pressure at the output port to stabilize at a predetermined regulated pressure less than $P_m$. If the fluid flow demand on the output suddenly increases, the output pressure decreases, thus decreasing $F_f$. This causes the valve spool 50 to move to the right, opening the input port wider to increase the flow of fluid until the output pressure at the output port 54 returns to the regulated pressure. Similarly, if the hydraulic flow demand on the output decreases, the output pressure increases, thus increasing $F_f$. This causes the valve spool 50 to move to the left to partially open the exhaust port 58 and reduce the output pressure to the regulated pressure.

When the winding current reaches a predetermined amount $I_m$, the combination of the magnetic force $F_m$ and the feedback force $F_f$ is sufficient to urge the armature plate 30 sufficiently toward the winding to cause the valve spool 50 to move to the left. This closes the input port 52 and allows the output pressure at the port 54 to vent to the exhaust port 58, thus reducing the actual output pressure to zero, as shown in FIG. 7*b*.

As previously mentioned, the gain of the valve assembly can be set by adjusting the position of the solenoid 10 relative to the valve 42 via the slot 44*a*. Thus, the output pressure at a given current level can be adjusted within certain ranges, as represented by dashed curves C1 and C2 shown in FIG. 7*b*.

By controlling the level of the current supplied to the solenoid, the output pressure of the valve can be regulated at an intermediate pressure between a zero output pressure level and a selected maximum output pressure level. This requires relatively precise positioning of the valve spool by the armature of the solenoid. With the solenoid of the present invention, such control is facilitated due to the operating characteristics of the solenoid. For example, with the solenoid of the present invention, when a predetermined constant current is applied to the winding, the magnetic force $F_m$ decreases as the armature plate moves closer to the winding. This provides the solenoid with a positive restoring force when positioning the valve spool 50, and results in a control device wherein the regulated output pressure of the valve is inversely proportional to the current applied to the solenoid winding, as shown in FIG. 7*b*.

It has been discovered that, in order to achieve the desired operating characteristics, the configuration of the upwardly facing surface 64 of the pole edge portion 16*a* and the downwardly facing surface 62 of the armature edge portion 30*a*, along with the relative movement therebetween, is critical. Such a configuration must result in the magnetic force $F_m$ which, when a constant current is applied to the solenoid winding, decreases as the armature is moved toward the winding through the desired operating range. In conventional solenoids, the magnetic force urging the armature toward the pole increases sharply as the distance between the armature and the pole member decreases.

To achieve the desired operating characteristics, the solenoid of the present invention is structured to control the magnitude of the force pivoting the armature plate toward the solenoid axis. For example, referring to FIG. 6, the magnetic field produced by the edge portion of the pole plate exerts a magnetic force $F_x$ on the armature plate 30 to urge the armature plate toward the axis of the field member. In the present invention, the pole plate 16 and the armature plate 30 have a construction such that, when a constant current is supplied to the solenoid, the magnitude of the force $F_x$ decreases as the armature plate 30 moves through a predetermined operating range (represented by distance R in FIG. 7*a*) toward the axis of the field member. As shown in FIG. 6, the downwardly facing surface 62 of the armature plate 30 is axially spaced from the upwardly facing surface 64 of the pole plate 16 to define an air gap 61 having a spacing G. As the armature plate 30 moves closer to the axis of the field member, the cross-sectional area of the air gap 61 increases, while the gap spacing G remains substantially uniform. It has been found that such a construction enables the magnetic energy in the air gap 61 to be controlled such that the magnitude of the force $F_x$ has the characteristics shown in FIG. 7*a*.

The magnetic force $F_x$ shown in FIG. 6 can be represented by the equation:

$$F_x = \frac{1}{2}(F_a)^2 \frac{dP}{dx}$$

where $F_a$=magnetomotive force in air gap 61 and dP/dx=rate of change of magnetic energy in air gap 61 as armature plate 30 moves toward the axis of the field member.

It has been found that, with the structure of the present invention, dP/dx remains approximately constant or slightly decreases as the armature plate moves closer to the field axis. As the cross-sectional area of the air gap increases, the total flux through the armature and field member will increase, thus causing an increase in the magnetomotive force in these parts, while decreasing the magnetomotive force $F_a$ in the air gap 61. As shown in FIG. 7*a*, this causes the magnitude of the magnetic force $F_m$ to continually decrease as the armature plate 30 moves from a point wherein an inner surface 30*b* of the plate 30 is aligned with the end surface 16*b* of the pole plate 16 to a point at which the plate 30 contacts the flange 21*a*. Also, this causes the distance the armature is moved to be proportional to the current applied to the solenoid winding.

While it has previously been mentioned that the air gap spacing is maintained "substantially uniform" during the movement of the armature, it has been found that slight variations in the air gap 61 as the armature plate 30 is pivoted can yield satisfactory results. Thus, the term "substantially uniform", for the purposes of this description and the attached claims, does not necessarily means constant, but defines a range over which the desired operating characteristics are obtained. In the embodiment shown in FIG. 6, the armature plate surface 62 and the pole plate surface 64 are planar and substantially parallel to one another when the inner surface 30*b* of the armature plate 30 is spaced a distance D inwardly from an outer end surface 16*b* of the pole plate 16. In one embodiment of the invention, the length L of the armature plate 30 is 1.113 inches, the distance G of the air gap is 0.013 inches, and the spacing D is 0.035 inches.

Referring to FIGS. 8 through 10, there are shown alternate embodiments relating to the shaping of the armature and pole plate surfaces which form the air gap utilized to control the positioning of the armature plate. In FIG. 8, the lower end of the armature plate 70 is provided with a surface 70*a* generally parallel to and spaced from a surface 72*a* of a pole plate 72. The armature plate includes an inclined surface 70*b* which functions to maintain a more uniform air gap distance as the armature plate 70 is pivoted toward the pole axis.

In FIG. 9, the lower end of an armature plate 80 is provided with a radial surface 80*a* formed about the pivot point P which cooperates with a radial surface 82*a* formed on a pole plate 82 about the pivot point P to maintain a relatively constant air gap as the armature plate is pivoted inwardly. In FIG. 10, the pole member 90 is provided with an upwardly facing radial surface 90*a*, while the armature plate 92 is provided with a generally planar downwardly facing surface 92*b*.

In accordance with the provisions of the patent statutes, the principles and mode of operation of the invention have been illustrated and described in what is considered to represent its preferred embodiment. It should, however, be understood that the invention may be practiced otherwise than as specifically illustrated and described without departing from its spirit and scope.

What is claimed is:

1. An electro-magnetic device comprising:

a field member having an axis;

a winding coaxially positioned around said field member;

said field member including a pole plate at one end thereof, said pole plate including a pole plate edge portion generally perpendicular to said axis and extending outwardly from said axis past said winding;

an armature pivotally mounted on the opposite end of said field member and including an armature plate extending axially toward and terminating short of said pole plate edge portion, said armature plate having an armature plate edge portion axially spaced from and generally parallel to said pole plate edge portion to define an air gap having a spacing which remains substantially uniform as said armature is pivoted relative to said field member, and means connected between said field member and said armature for biasing said armature plate edge portion away from said axis of said field member, said armature plate edge portion moveable toward said axis against the action of said biasing means upon application of a predetermined current to said winding.

2. The device according to claim 1 wherein said pole member includes a pivot plate at said opposite end for pivotally mounting said armature, said pivot plate including a pivot plate edge portion contacting said armature plate along a pivot line spaced from and perpendicular to said axis of said pole member.

3. The device according to claim 2 wherein said armature includes a biasing leg attached to said armature plate and extending along said pivot plate, and said biasing means is connected to urge said biasing leg toward said pivot plate, thereby urging said armature plate away from said axis of said field member.

4. The device according to claim 2 including means for resisting movement of said armature along said pivot line.

5. The device according to claim 4 wherein said resisting means includes a ball located in and projecting from a cavity formed in said armature and facing said pivot line, said pivot plate edge portion provided with a notch for receiving the portion of said ball projecting from said cavity.

6. The device according to claim 1 wherein said pole member includes a central tube having one end securely attached to said pivot plate and an opposite end securely attached to said pole plate, and insulating bobbin means for spacing said winding from said pole member, said insulating means include a pair of cooperating bobbin halves around which said winding is positioned.

7. The device according to claim 1 wherein said biasing means includes means for adjusting the biasing force on said armature plate.

8. The device according to claim 1 wherein said armature plate edge portion includes a first surface and said pole plate edge portion includes a second surface axially spaced from said first surface, said first and second surfaces cooperating to define an air gap which increases in cross-sectional area as said armature plate moves toward said axis.

9. The device according to claim 8 wherein said first and second surfaces are planar and generally parallel with one another when said armature plate is perpendicular to said pole plate.

10. The device according to claim 8 wherein said second surface is generally radial about a pivot axis of said armature.

11. The device according to claim 8 wherein said first surface is generally radial about a pivot axis of said armature.

12. The device according to claim 8 wherein said second surface is planar and said first surface includes a first planar portion generally parallel with said second surface when said armature plate is perpendicular to said pole plate, and a second inclined portion inclined away from said second surface when said armature plate is perpendicular to said pole plate.

13. The device according to claim 8 wherein said valve unit includes an axis and said valve spool is mounted for axial movement within an axial bore formed in said valve unit, said valve unit further including means for generating an axial feedback force on said valve spool in the same direction as said magnetic force corresponding to the actual output pressure at which the fluid is being delivered from said output port.

14. The device according to claim 13 wherein said armature edge portion is coupled to one end of said valve spool by a ball.

15. The device according to claim 13 wherein one end of said valve spool is coupled to said armature portion and the opposite end of said valve spool is exposed to feedback fluid at the actual output pressure for exerting said feedback force.

16. The device according to claim 15 wherein the opposite end of said valve spool has a predetermined area and said feedback fluid is supplied to the opposite end of said valve spool through a passageway have a cross-sectional area less than said predetermined area.

17. The device according to claim 8 including means for adjustably mounting said solenoid relative to said valve unit.

18. An electronic valve assembly comprising, in combination:

a valve unit having an input port for receiving fluid at a predetermined supply pressure and an output port for delivering fluid at a desired output pressure, said valve unit including a moveable valve spool for selecting the desired output pressure; and a solenoid coupled to operate said valve unit, said solenoid including a field member having an axis, a winding coaxially positioned around said field member, said field member including a pole plate at one end thereof, said pole plate including a pole plate edge portion generally perpendicular to said axis and extending outwardly from said axis past said winding, an armature pivotally mounted on the opposite end of said field member and including an armature plate extending axially toward and terminating short of said pole plate edge portions, said armature plate having an armature plate edge portion axially spaced from and generally parallel to said pole plate edge portion to define an air gap having a spacing which remains substantially uniform as said armature is pivoted relative to said field member, said armature plate movable toward said axis and coupled to position said valve spool in a selected position upon application of a predetermined current to said winding, and means connected between said field member and said armature for biasing said armature plate away from said axis of said field member.

19. The valve assembly according to claim 18 wherein said armature plate is coupled to said valve spool at a location between the location at which the armature is pivotally mounted on said pole member and said armature plate edge portion.

* * * * *